US006047506A

United States Patent [19]

Kemper

[11] Patent Number: 6,047,506

[45] Date of Patent: Apr. 11, 2000

[54] STAIR EDGE PROFILE ASSEMBLY

[76] Inventor: Hans August Kemper, Wehestr. 19, D58566, Kierspe, Germany

[21] Appl. No.: 08/603,951

[22] Filed: Feb. 16, 1996

[30] Foreign Application Priority Data

Nov. 8, 1995 [EP] European Pat. Off. ..... 95117609

[51] Int. Cl.[7] ..... E04F 11/16

[52] U.S. Cl. ..... 52/179; 52/716.8

[58] Field of Search ..... 52/174, 179, 716.1, 52/716.3, 716.4, 716.8, 717.05, 717.06, 718.01, 718.04, 718.05, 718.02, 177; 108/27; 312/140.3, 140.4

[56] References Cited

U.S. PATENT DOCUMENTS

| | | | |
|---|---|---|---|
| 1,767,782 | 6/1930 | Awbrey | 52/179 |
| 2,487,571 | 11/1949 | Maxwell | 52/718.04 |
| 4,321,294 | 3/1982 | Naka | 52/179 |
| 4,893,449 | 1/1990 | Kemper | 52/717.06 |
| 5,252,376 | 10/1993 | Greenberg et al. | 52/718.04 |

FOREIGN PATENT DOCUMENTS

| | | | |
|---|---|---|---|
| 645569 | 11/1950 | United Kingdom | 52/179 |

*Primary Examiner*—Michael Safavi
*Attorney, Agent, or Firm*—Stroock & Stroock & Lavan LLP

[57] ABSTRACT

A stair edge profile assembly formed of a tread angle member having a tread limb portion whose free end is in the form of a cover blade member extending over a stair tread covering. The tread angle member carries an abutment limb substantially at a right angle to the cover blade member. The assembly further includes a base profile member which can be fixed on the stair structure. The tread angle member can be fixed on the base profile member by way of a holding means affording adjustment in height, so the height of the tread angle member can be so set in dependence on the thickness of the material of the tread covering that the cover blade member comes to lie on the tread covering.

15 Claims, 4 Drawing Sheets

STAIR EDGE PROFILE ASSEMBLY

FIELD OF THE INVENTION

The invention concerns a stair edge profile assembly for fitting to the front edge or nose of a stair or step forming for example part of a staircase or the like.

BACKGROUND OF THE INVENTION

Stairs or steps are frequently covered by a stair covering which may cover the surface of each stair tread and which may also cover the vertical surface of the stair riser. In one form of stair edge profile assembly for use in such a situation, the assembly comprises a tread angle member having a tread limb portion whose free end forms a cover blade portion for extending over a covering on the stair tread. Arranged on the tread angle member at a right angle thereto is an abutment limb, while the assembly further comprises a base profile member which can be fixed on the stair. Such an arrangement is to be found for example in U.S. Pat. No. 4,455,797 in which the base profile member is fitted in a L-shape around the stair edge and fixed to the stair by means of a nail. At the stair edge the base profile member has an inclined surface serving as an abutment contact surface for the tread angle member. The outsides of the base profile member and the inside of the tread angle member fit together in positively locking relationship. The tread angle member is made from plastic material and has air chambers therein in order to improve the damping properties of the assembly. Provided on the tread angle member at both ends thereof are so-called cover blade portions which, after the tread angle member has been fitted on to the base profile member on the stair, press the tread covering against the base profile member. Use of this assembly is restricted to carpets which are compressed and clamped in position between the cover blade portion and the base profile member.

A disadvantage of this construction is also the consideration that use thereof is restricted to stair coverings of a quite specific thickness of material. When laying for example carpeting of a greater thickness or when using laminate or parquet floor coverings, a different tread angle member has to be used for each specific thickness of material.

SUMMARY OF THE INVENTION

An object of the present invention is to provide an improved stair edge profile assembly such that it can be used for stair coverings of different thicknesses of material.

Another object of the present invention is to provide a stair edge profile assembly which is of a simple construction which can be easily assembled and fitted in position while affording enhanced operating characteristics in terms of holding a stair covering in position.

Still another object of the present invention is to provide a stair edge profile assembly which is highly user-friendly even from the point of view of a relatively unskilled person.

In accordance with the present invention the foregoing and other objects are achieved by a stair edge profile assembly comprising a tread angle member having a tread limb portion whose free end constitutes a cover blade portion for extending over a stair covering on a stair tread. An abutment limb is arranged on the tread angle member substantially at a right angle thereto, and a base profile member is adapted to be fixed on the stair. The tread angle member can be fixed to the base profile member by a holding means which is adjustable in respect of height so that the cover blade portion comes to lie on the stair covering on the tread.

Advantageously the tread angle member and the base profile member are releasably connected together by way of the height-adjustable holding means. Particularly when laying parquet and laminate coverings on spiral staircases, it is very important that the tread angle member can already be fitted in place in order to indicate the position of the base profile member. In order to be able to lay the parquet or laminate covering, the tread angle member has to be removed again as a stiff stair covering cannot be threaded into position under the cover blade portion, particularly when dealing with a spiral staircase.

It is also desirable if the tread angle member has first and second guide support surfaces which extend parallel to each other and at a spacing from each other and which co-operate with appropriately associated co-operating surfaces on the base profile member. The co-operation of the guide support surfaces with the co-operating surfaces on the base profile member ensures vertical displaceability of the tread angle member. The moment when standing on the stair edge profile assembly is also transmitted to the base profile member by virtue of the clever arrangement of the guide support surfaces and the above-mentioned co-operating surfaces.

In that respect, in another preferred feature of the invention, arranged on the tread limb is a leg portion which is directed substantially towards the stair tread on which the assembly is fitted and on the side of which that is directed towards the stair edge is the first guide support surface, while at the corresponding location on the base profile member a corresponding leg portion has the co-operating surface which is towards the first guide support surface.

In another preferred feature of the invention the second guide support surface is provided on the abutment limb and the associated cooperating surface is provided on an end edge of the base profile member, which end edge is directed substantially forwardly in relation to the stair tread on which the assembly is used.

An advantageous alternative in that respect provides that the second support guide surface is provided on the abutment limb and the associated co-operating surface is provided on a second leg portion arranged at a suitable location on the base profile member.

For the purposes of adjustability of the height of the tread angle member, it is highly advantageous for the leg portions to be so arranged on the base profile member and for the insides of the leg portions to be of such a configuration that they form a screwthreaded drive passage.

Desirably, for that purpose, countersink holes are also provided on the tread limb, for receiving drive screws. The spacing between the tread angle member and the base profile member is so adjusted by way of the screws that the cover blade portion comes to lie appropriately on the stair covering. When the screws are screwed into the screwthreaded drive passage the wall of the leg portion on the base profile member is pressed with the guide support surface against the co-operating surface on the leg portion of the tread angle member. Therefore, simultaneously with heightwise adjustment, a clamping action is produced as between the tread angle member and the base profile member.

In a desirable modification of this arrangement the respectively co-operating surfaces are in the form of retaining or detent surfaces.

In a further desirable alternative configuration the height-adjustable holding means is in the form of at least one retaining or detent leg portion having projections, at the left and at the right sides, at the underside of the tread limb, wherein the projections can be engaged into corresponding recesses at the insides of the leg portions. By virtue of that retaining configuration the tread angle member and the base profile member can be easily assembled and dismantled.

In order to provide for finer graduation in terms of adjustment in respect of height, it is highly advantageous if the projections for example on the left are displaced relative to the projections for example on the right of the at least one retaining or detent leg portion by a predetermined distance, or if the recesses for example on the left are displaced relative to the recesses for example on the right of the leg portions by a predetermined distance relative to each other.

In a preferred feature of that assembly the retaining or detent leg portions are resilient around their connecting location to the tread limb.

In a preferred embodiment of the invention bore holes are provided in the base profile member for fixing it to the stair.

In order to give an at least substantially non-slip surface it may be desirable for the tread limb to be provided with grooves or channels extending in the longitudinal direction of the assembly, at the outside of the tread limb, with grooves or channels at the transition of the tread limb, the abutment limb and/or the cover blade portion.

So that the base profile member can be securely fixed on the stair and the stair covering lies on the base profile member in a non-displaceable condition, the horizontal portion of the base profile member may be provided with a profiling means at its top side and/or its underside.

If the stair edge assembly is set for the minimum possible thickness of material of stair covering, then provided at the inside of the abutment limb is a step which defines the lowest position of the tread angle member. That thickness of stair covering is advantageous in the case of stair edges which are subjected to an extremely high level of loading as the tread angle member can bear against the profile member in the abutment position by way of the abutment.

The tread angle member and the base profile member can be advantageously made from aluminum.

Other advantageous and preferable features and configurations of the invention are set forth in the following description and in the accompanying claims.

Further objects, features and advantages of the invention will be apparent from the following description of a preferred embodiment.

DESCRIPTION OF PREFERRED EMBODIMENTS

Figure 1:
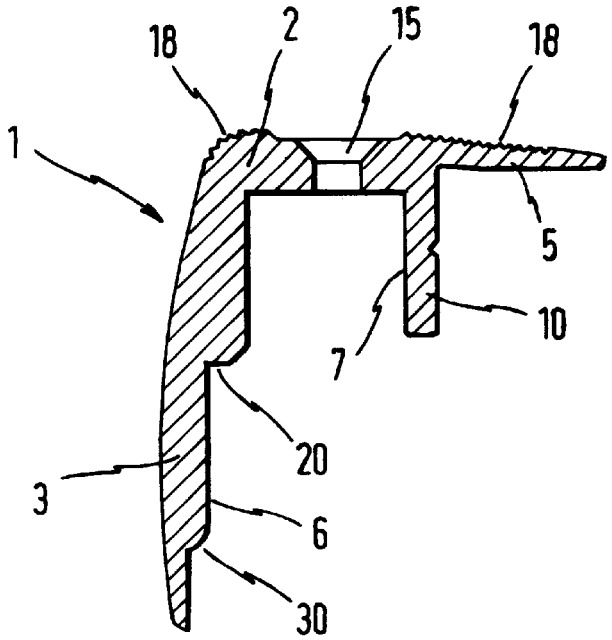
FIG. 1 is a side view of a tread angle member of the assembly according to the invention.

Referring firstly to FIG. 1, shown therein is a side view of a tread angle member 1 as is used in a stair edge assembly according to the invention. The tread angle member 1 comprises a tread limb 2 and an abutment limb 3 which is arranged substantially perpendicularly relative thereto. Provided on the tread limb 2 in substantially parallel relationship to and at a predetermined spacing from the abutment limb 3 is a leg portion 10 whose side that is directed towards the abutment limb 3 forms a first guide support surface 7. The tread limb 2 extends beyond the leg portion 10 and in that region, at its free end, forms a portion which is referred to herein as a cover blade portion 5. The cover blade portion 5 tapers slightly towards its free end and is of a rounded-off configuration thereat. In its position the cover blade portion 5 is slightly inclined towards the top side of the stair tread. Provided in the tread limb 2 in the region between the leg portion 10 and the abutment limb 3 are countersink holes 15 into which drive screws as indicated at 16 in for example FIG. 3 can be inserted upon fitting of the assembly. Provided at the surface of the tread limb 2 in the transition between the tread limb 2 and the abutment limb 3 and in the region above the leg portion 10 and the cover blade portion 5 are grooves or channels 18 which extend in the longitudinal direction of the assembly in order to provide a non-slip surface which thus affords a reliable grip for the feet. The outside of the abutment limb 3 is in the form of an inclined surface which goes downwardly into a radial curvature. In this embodiment, as viewed from below, the inside of the abutment limb 3 has a first step 30, after which the inside goes into a guide support surface 6 which is adapted to co-operate with the end of a bottom plate portion of the base profile member 4. However, it is also possible to provide a particular thickened portion on the base profile member, for such an end surface.

Adjoining the guide support surface 6 the inside of the abutment limb 3 has an abutment 20 which, when the tread angle member 1 is pushed on to the base profile 4, defines the smallest thickness of for example parquet stair covering.

Figure 2:
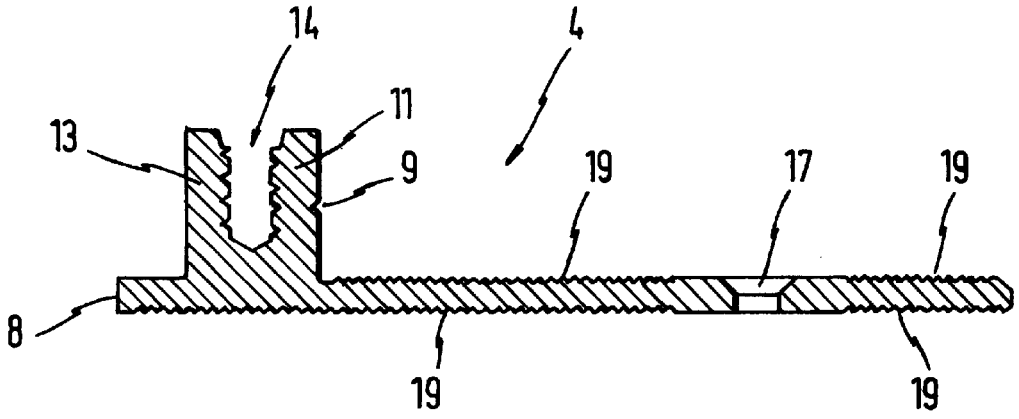
FIG. 2 is a side view of a base profile member of the assembly according to the invention.

FIG. 2 shows a side view of a base profile member 4 which co-operates with the tread angle member 1 shown in FIG. 1. The base profile member 4 has a substantially horizontal bottom plate portion, at the end of which is provided a co-operating surface 8 adapted to co-operate with the guide support surface 6 at the inside of the abutment limb 3. Arranged on the base profile member 4 are first and second leg portions 11 and 13 which are so profiled at the inward sides thereof that they form a screwthreaded drive passage 14 for screwing in the above-mentioned drive screws 16. Provided on the outside of the leg portion 11 which is at the right in FIG. 2 is the co-operating surface 9 for co-operating with the guide support surface 11 at the inside of the leg portion 10 of the tread angle member 1. Provided in the bottom plate portion of the base profile member 4 are bore holes 17 by way of which the base profile member 4 is fixed to the stair. The bottom plate portion of the base profile member 4 is provided on both sides with a profiling configuration as indicated at 19 so that the base profile member 4 can be non-displaceably fixed on the stair and the stair covering 12 can be non-displaceably fixed on the base profile member.

Figure 3:
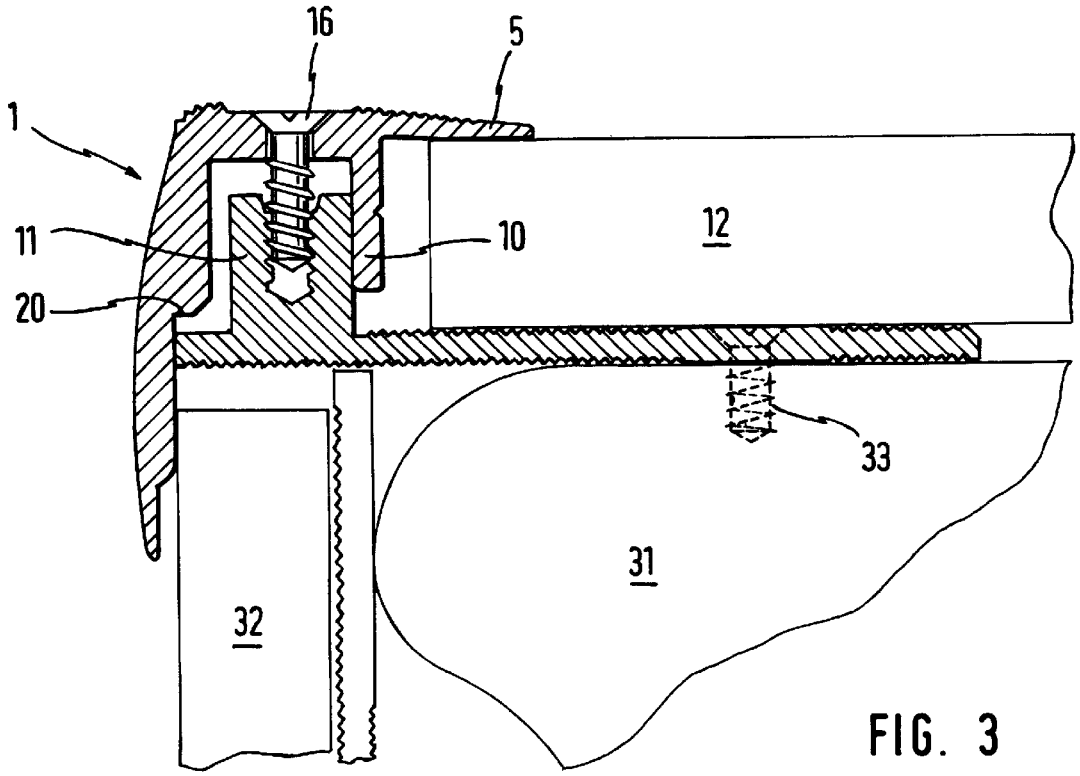
FIG. 3 shows the tread angle member and the base profile member in the mounted condition when using a vertical riser.

Reference will now be made to FIG. 3 showing the tread angle member 1 and the base profile member 4 in the fitted condition. It will be seen that the base profile member 4 is fixed to a stair tread 31 by way of screws indicated at 33. In this embodiment the base profile member 4 is arranged in such a way that a vertical riser 32 can be mounted at the end of the step. For positioning of the base profile member 4, it is very important that the tread angle member 1 can be briefly fitted in position on the stair. For the purposes of inserting the stair covering 12 however it is again advantageous and, when dealing with laminate and parquet stair coverings, necessary, that the tread angle member 1 can be removed again. In this embodiment the tread angle member 1 is pushed on to the base profile member 4 until the cover blade portion 5 comes to lie against the top side or upwardly facing surface of the stair covering 12. Thereafter the tread angle member 1 is fixed on the base profile member 4 by way of the screws 16. When the screws 16 are screwed in, the leg portion 11 of the base profile member 4 is clamped to the leg portion 10 of the tread angle member 1. The abutment 20 does not come into operation here as the stair covering 12 involves a material of a thickness which is above the smallest possible thickness that can be used.

Figure 4:
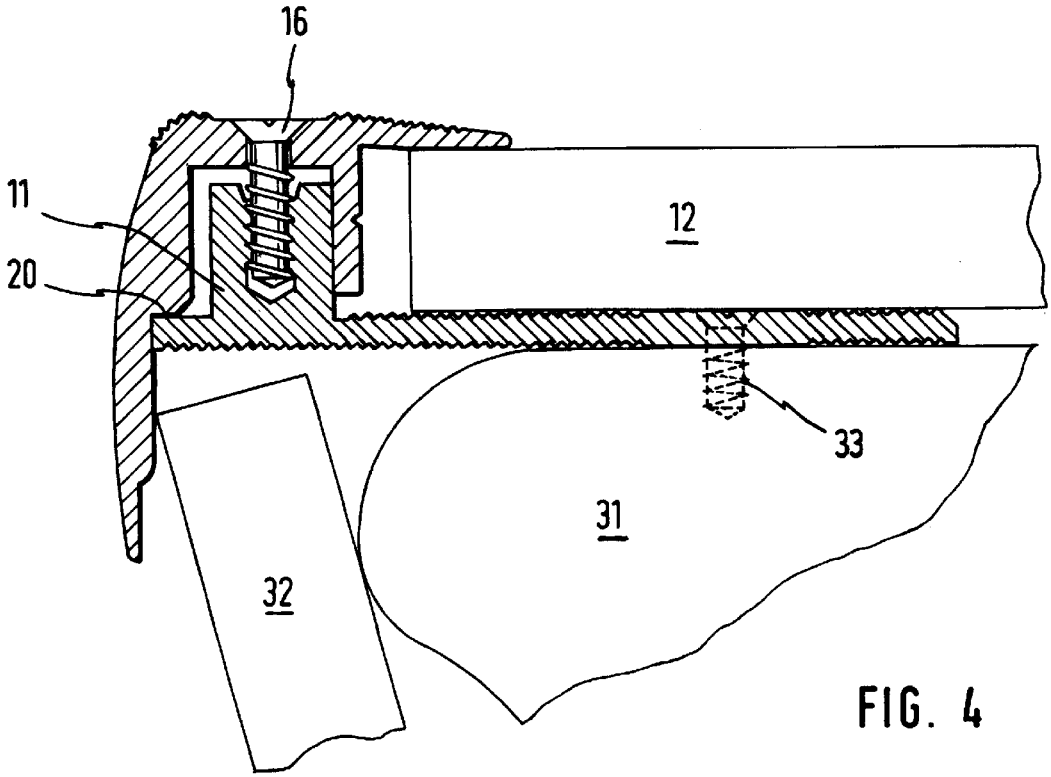
FIG. 4 shows the tread angle member and the base profile member in the mounted condition with a minimal stair covering thickness and when using an inclined riser.

FIG. 4 also shows the tread angle member 1 of FIG. 1 and the base profile member 4 of FIG. 2 in the fitted condition. In this embodiment the thinnest possible stair covering 12 is used so that the abutment 20 comes to bear against the surface of the base profile member 4. The base profile member 4 and the tread angle member 1 may if necessary be produced in different sizes so that the assembly offers the optimum adjustment range for any stair covering 12. In this embodiment the stair edge assembly is used in conjunction with an inclined riser portion 32.

Figure 5:
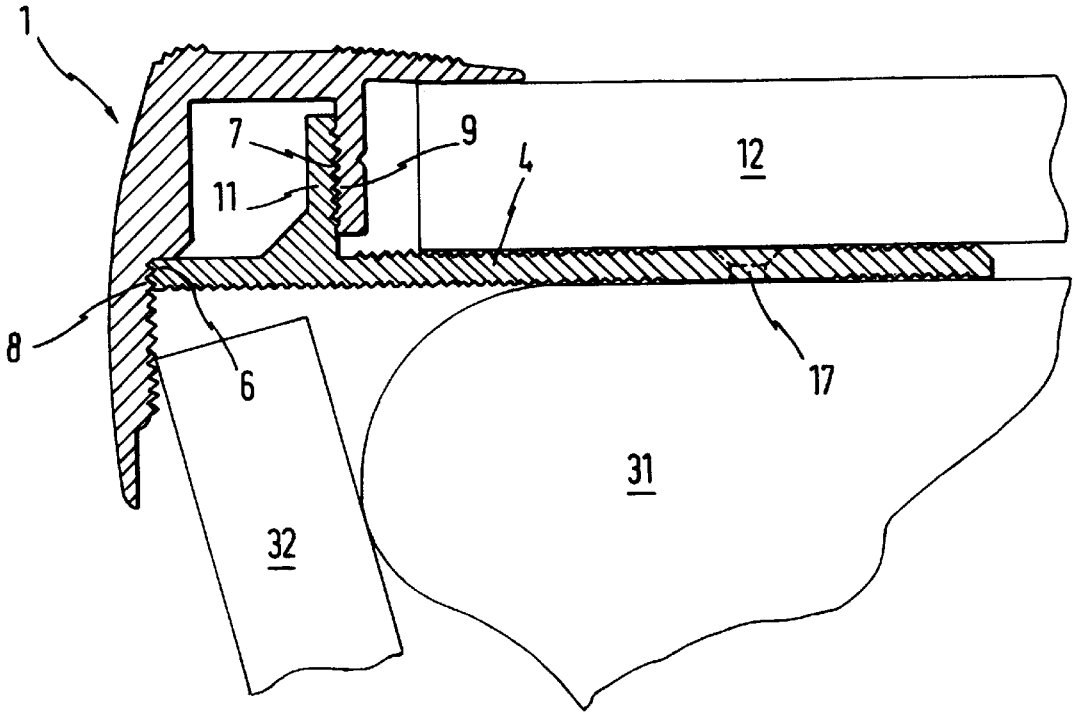
FIG. 5 shows a further embodiment of a tread angle member and base profile member with retaining surfaces.

Reference will now be made to FIG. 5 showing a further embodiment in which the guide support surfaces 6 and 7 referred to above and the corresponding co-operating surfaces 8 and 9 are of a detent or retaining configuration. In this embodiment the base profile member 4 has only one leg portion as indicated at 11. In this embodiment also no bore holes 15 are provided in the tread angle member 1. FIG. 5 shows the fitting condition when the stair covering 12 used as of minimum thickness. It will be appreciated that this construction can also be used when dealing with thicker stair coverings 12.

Figure 6:
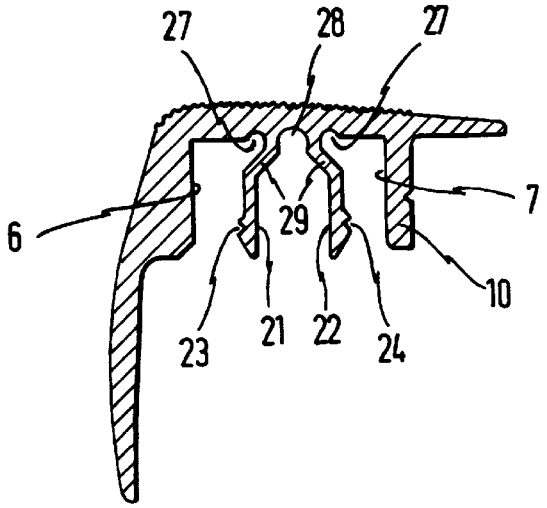
FIG. 6 is a view in cross-section of a tread angle member with retaining leg portions.

FIG. 6 is a view in cross-section through an alternative form of the tread angle member 1. For the purposes of fixing the tread angle member 1 on a base profile member 4 which is fixed on the stair, first and second retaining or detent leg portions 21 and 22 are provided in substantially perpendicular relationship on the tread limb 2. The retaining or detent leg portions 21 and 22 have on their outsides projections 23 and 24 for arresting same on the base profile member 4. In this embodiment the projections 23 and 24 are of a symmetrical configuration but it will be appreciated that in a modified embodiment they may also be arranged in mutually displaced relationship, through a predetermined distance. The projections 23 and 24 are shown here in the form of teeth whose outwardly facing surface is at a shallower angle than the rear surface thereof, with respect to the longitudinal axis of the respective leg portions 21, 22. The leg portions 21 and 22 are designed to be resilient around their respective connection to the tread limb 2. The transition of the leg portions 21, 22 to the tread limb 2 is rounded off in each case by an outside radius 27 and by an inside radius 28. The wall of the leg portions 21, 22 is displaced inwardly relative to the connections thereof to the tread limb 2, by respective inclined transitional portions 29.

Figure 7:
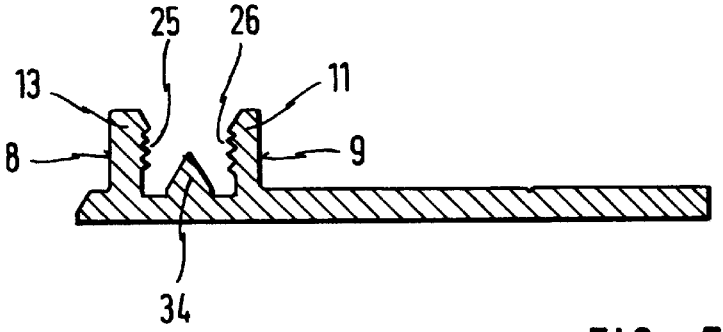
FIG. 7 is a view in cross-section of the base profile member corresponding to the tread angle member from FIG. 6.

FIG. 7 is a view in cross-section through the base profile member 4 corresponding to the tread angle member 1 shown in FIG. 6. At their insides the leg portions 11 and 13 have recesses 25 and 26 which in this embodiment are arranged in displaced relationship relative to each other by half the spacing between the respective recesses. At the upper insides the leg portions 11 and 13 are bevelled by virtue of the provision of a chamfer. Arranged between the two leg portions 11 and 13 is a deflection device 34 in the shape of a prism which faces with its tip upwardly.

Figure 8:
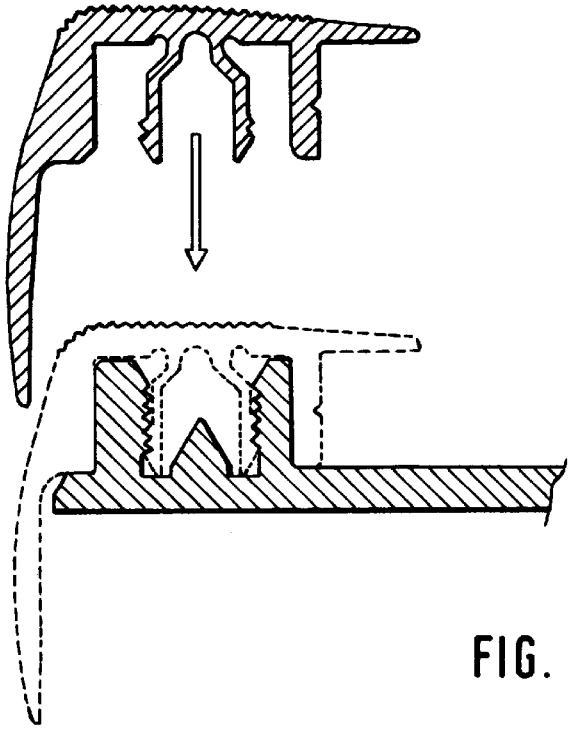
FIG. 8 is a view in cross-section of the stair edge assembly as shown in FIGS. 6 and 7.

Referring now to FIG. 8, the tread angle member 1 and the base profile member 4 are shown therein in the dismantled and in the mounted conditions. The mounted condition shows only one fitting position, the tread angle member 1 being pushed fully on to the base profile member 4 in the fitting position illustrated. This is the position for the minimum possible thickness of material of the stair covering in the prestressed condition.

It will be clearly seen, in the fitted condition, how the two guide support surfaces 6 and 7 embrace the two leg portions 11 and 13 and bear directly against the co-operating surfaces 8 and 9 of the leg portions 11 and 13. The thickness of the leg portions 11 and 13 is so selected that they almost completely fill the opening between the guide surfaces on the leg portions 11 and 13 and the outsides of the leg portions 21 and 22. The height of the leg portions 11 and 13 is matched to the height of the leg portions 21 and 22, as also to the height of the leg portion 10 and the guide surface 6.

In this fitted condition as illustrated, only the leg portion 21 at the left engages with its projections 23 into the recesses 27 in the left-hand leg portion 11. The right-hand leg portion 22, with its projections 24, is held resiliently out of engagement with the corresponding recesses in the illustrated fitted condition as the recesses 27, 28 in the leg portions 11 and 13 are displaced relative to each other by half the spacing between the respectively adjacent recesses.

It will be appreciated that the above-described embodiments of the present invention have been set forth solely by way of example and illustration of the principles thereof and that various modifications and alterations may be made therein without thereby departing from the spirit and scope of the present invention.

What is claimed is:

1. A stair edge profile assembly comprising:

a tread angle member having a substantially horizontal tread limb portion and a substantially vertical abutment limb;

the tread limb portion having a top surface and a bottom surface and a free end adapted to form a cover blade portion for contacting a stair covering;

the abutment limb having an outside surface and an inside surface and extending away from said bottom surface of said tread limb; and a base profile member adapted to be fixed on a stair, the base profile member having a bottom surface and further comprising a first leg portion and a second leg portion arranged on the base profile member, said first and second leg portions forming a screwthreaded drive passage; and a holding means engaging said tread angle member and said base profile member to fix said tread angle member to said base profile member, wherein said abutment limb extends beyond said bottom surface of said base profile member, said holding means being so constructed as to permit adjustment of said cover plate member.

2. The assembly as set forth in claim 1 wherein the holding means is height-adjustable holding means and is adapted to releasably connect the tread angle member and the base profile member.

3. The assembly as set forth in claim 1 wherein the tread angle member comprises first and second guide support surfaces which extend at least substantially parallel to and at a spacing from each other and the base profile member has co-operating surfaces which are adapted to co-operate with said guide support surfaces.

4. The assembly as set forth in claim 3 wherein the tread limb comprises a leg portion which is directed substantially towards a stair tread, said first guide support surface is disposed on the side of said leg portion which is directed towards a stair edge, and wherein at a corresponding location the base profile member has a corresponding first leg portion having a cooperating surface for cooperating with said first guide support surface.

5. The assembly as set forth in claim 3 wherein the second guide support surface is provided on the abutment limb and wherein the base profile member has an end edge which has a co-operating surface and which is directed substantially forwardly in the mounted condition on a stair.

6. The assembly as set forth in claim 1 including at least one hole on the tread limb for receiving a drive screw.

7. The assembly as set forth in claim 1 wherein the base profile member has at least one hole for receiving a screw.

8. The assembly as set forth in claim 1 wherein the tread limb has groove means extending in the longitudinal direction of the profile member at the outside of the tread limb.

9. The assembly as set forth in claim 1 including at least one groove forming a portion of a non-slip surface at the transition of the tread limb and the abutment limb.

10. The assembly as set forth in claim 1 including at least one groove forming a portion of a non-slip surface on the cover blade portion.

11. The assembly as set forth in claim 1 wherein the base profile member has a horizontal portion with a profiler at at least one of its top side and its underside.

12. The assembly as set forth in claim 1 including a step at the inside of the abutment limb.

13. The assembly as set forth in claim 1 wherein the outside of the abutment limb is in the form of an inclined surface which goes downwardly into a radial curvature.

14. The assembly as set forth in claim 1 wherein the tread angle member and the base profile member comprise aluminum.

15. The assembly as claimed in claim 6 wherein the hole is a countersink.

* * * * *